US012102276B2

(12) United States Patent
Xuan et al.

(10) Patent No.: US 12,102,276 B2
(45) Date of Patent: Oct. 1, 2024

(54) SELF-MOVING CLEANING DEVICE

(71) Applicant: MIDEA ROBOZONE TECHNOLOGY CO., LTD., Suzhou (CN)

(72) Inventors: Xiaogang Xuan, Suzhou (CN); Shupeng Feng, Suzhou (CN); Xianmin Wei, Suzhou (CN); Yuan Chen, Suzhou (CN)

(73) Assignee: MIDEA ROBOZONE TECHNOLOGY CO., LTD., Suzhou (CN)

( * ) Notice: Subject to any disclaimer, the term of this patent is extended or adjusted under 35 U.S.C. 154(b) by 506 days.

(21) Appl. No.: 17/434,759

(22) PCT Filed: Aug. 20, 2019

(86) PCT No.: PCT/CN2019/101635
§ 371 (c)(1),
(2) Date: Aug. 30, 2021

(87) PCT Pub. No.: WO2020/252884
PCT Pub. Date: Dec. 24, 2020

(65) Prior Publication Data

US 2022/0160203 A1 May 26, 2022

(30) Foreign Application Priority Data

Jun. 17, 2019 (CN) ..... 20192091043.1

(51) Int. Cl.
*A47L 1/02* (2006.01)
*A47L 11/24* (2006.01)
(Continued)

(52) U.S. Cl.
CPC ..... *A47L 11/4072* (2013.01); *A47L 1/02* (2013.01); *A47L 11/24* (2013.01); *A47L 11/28* (2013.01);
(Continued)

(58) Field of Classification Search
CPC .. A47L 11/4072; A47L 11/4083; A47L 11/28; A47L 11/4063; A47L 11/408; A47L 2201/00; A47L 2201/04
See application file for complete search history.

(56) References Cited

U.S. PATENT DOCUMENTS

2004/0049877 A1 3/2004 Jones et al.
2009/0100630 A1* 4/2009 Kim ..... A47L 9/1463 15/319
(Continued)

FOREIGN PATENT DOCUMENTS

CN 204105903 U 1/2015
CN 104644066 A 5/2015
(Continued)

OTHER PUBLICATIONS

OA received in KR application 10-2021-7031322; mailed Jan. 12, 2023.
(Continued)

*Primary Examiner* — Eric J Rosen
*Assistant Examiner* — Sharonda T Felton

(57) ABSTRACT

Provided is a self-moving cleaning device, including a shell, a water tank, a groove, and a roller assembly. A mounting part is arranged at the bottom of the shell; the water tank is detachably mounted on the mounting part; the groove is provided in the mounting part and/or the groove is provided in the water tank at a position cooperating with the mounting part; and the roller assembly is mounted on the mounting part and can extend and retract. When the water tank is
(Continued)

mounted on the shell, the roller assembly retracts into the groove and is in a retracted state, and when the water tank is removed from the shell, the roller assembly is in an extended state.

10 Claims, 5 Drawing Sheets

(51) Int. Cl.
*A47L 11/28* (2006.01)
*A47L 11/40* (2006.01)

(52) U.S. Cl.
CPC ..... *A47L 11/4083* (2013.01); *A47L 2201/04* (2013.01)

(56) References Cited

U.S. PATENT DOCUMENTS

| | | | | |
|---|---|---|---|---|
| 2012/0090126 | A1* | 4/2012 | Kim ..... | G05D 1/0238 15/319 |
| 2016/0058256 | A1 | 3/2016 | Ju et al. | |

FOREIGN PATENT DOCUMENTS

| | | | | | |
|---|---|---|---|---|---|
| CN | 204600371 | U | | 9/2015 | |
| CN | 105433863 | A | | 3/2016 | |
| CN | 105455734 | A | | 4/2016 | |
| CN | 205433581 | U | | 8/2016 | |
| CN | 205458439 | U | | 8/2016 | |
| CN | 106108776 | A | | 11/2016 | |
| CN | 205729251 | U | | 11/2016 | |
| CN | 106264330 | A | | 1/2017 | |
| CN | 106436619 | A | | 2/2017 | |
| CN | 106667380 | A | | 5/2017 | |
| CN | 207253312 | U | | 4/2018 | |
| CN | 207640328 | U | | 7/2018 | |
| CN | 108443512 | A | | 8/2018 | |
| CN | 108720742 | A | | 11/2018 | |
| CN | 109222762 | A | | 1/2019 | |
| CN | 109330473 | A | | 2/2019 | |
| CN | 208582332 | U | | 3/2019 | |
| CN | 208625588 | U | | 3/2019 | |
| CN | 208851402 | U | | 5/2019 | |
| CN | 209091195 | U | | 7/2019 | |
| CN | 209750931 | U | | 12/2019 | |
| EP | 1969438 | A1 | | 9/2008 | |
| EP | 3241477 | A1 | | 11/2017 | |
| GB | 325745 | A | | 2/1930 | |
| JP | S5226470 | A | | 2/1977 | |
| JP | H0385127 | A | | 4/1991 | |
| KR | 100784723 | B1 | | 12/2007 | |
| KR | 20080022342 | A | | 3/2008 | |
| KR | 20120105807 | A | | 9/2012 | |
| KR | 20140000811 | A | | 1/2014 | |
| KR | 2017142023 | A | * | 12/2017 | ..... A47L 11/03 |
| KR | 20190022844 | A | | 3/2019 | |
| WO | 2016008446 | A1 | | 1/2016 | |

OTHER PUBLICATIONS

OA received in KR application 10-2021-7024191; mailed Feb. 14, 2023.
First OA received in CN application 201811168860.0; mailed Jul. 27, 2023.
Search Report mailed Apr. 14, 2022 for EP application 19933481.4.
Search Report mailed Apr. 12, 2022 for EP application 19918835.0.
First OA mailed Jun. 1, 2022 for CN application 201910111720.8.
OA mailed Oct. 4, 2022 for JP application 2021-554771.
ISR for PCT application PCT/CN2019/101635.

* cited by examiner

SELF-MOVING CLEANING DEVICE

CROSS-REFERENCES TO RELATED APPLICATIONS

The present disclosure is a national phase application of International Application No. PCT/CN2019/101635, filed on Aug. 20, 2019, which claims priority to Chinese Patent Application NO. 201920910431.X, filed on Jun. 17, 2019, the entireties of which are herein incorporated by reference.

FIELD

This application relates to the field of self-moving cleaning technology and, more particularly, to a self-moving cleaning device.

BACKGROUND

This section provides background information related to this application, which is not necessarily the prior art.

As shown in FIG. 1, a water tank is arranged at the bottom of a shell of a floor sweeping robot, a roller is arranged at the bottom of the water tank, and an omnidirectional wheel cooperating with the roller is arranged at the bottom of the shell and in a position offset from the water tank. When the floor sweeping robot is working, the omnidirectional wheel and the roller cooperate to provide support force for the floor sweeping robot, so that the floor sweeping robot can run smoothly on the floor. Since the water tank is detachably mounted at the bottom of the shell, sometimes the water tank will be removed from the shell during practical use of the floor sweeping robot, and the floor sweeping robot will move on the floor and clean the floor by a rolling brush and a side brush. In such a situation, the roller mounted at the bottom of the water tank is removed along with the removal of the water tank from the floor sweeping robot, a part of the floor sweeping robot located on the water tank loses the support force, which will lead to shaking of the floor sweeping robot when moving on the floor and affect normal work of the floor sweeping robot.

SUMMARY

The present disclosure aims to solve the problem that the existing self-moving cleaning device has poor stability after the removal of the water tank at least to a certain extent.

In one embodiment of the present disclosure provides a self-moving cleaning device. The self-moving cleaning device includes: a shell, a water tank, a groove, and a roller assembly. The mounting part is arranged at a bottom of the shell; the water tank is detachably mounted on the mounting part; the groove arranged in the mounting part and/or arranged in the water tank at a position cooperating with the mounting part; the roller assembly is mounted on the mounting part and can extend and retract. When the water tank is mounted on the shell, the roller assembly retracts into the groove and is in a retracted state; when the water tank is removed from the shell, the roller assembly is in an extended state.

In the present disclosure, the roller assembly is arranged in the groove of the self-moving cleaning device, and the roller assembly can extend from the groove when the water tank is removed from the self-moving cleaning device, so that the self-moving cleaning device can be supported and a phenomenon of poor stability of the self-moving cleaning device occurring after removal of the water tank can be avoided.

In addition, the above self-moving cleaning device according to the present disclosure can have the following additional features.

According to an embodiment of the present disclosure, the roller assembly includes a roller bracket and a roller; a first end of the roller bracket is mounted on the mounting part, and a second end of the roller bracket is rotatably connected to the roller; and the roller bracket is configured to drive the roller to retract into or extend from the groove.

According to an embodiment of the present disclosure, the roller assembly includes an elastic element, a first end of the elastic element being mounted to the mounting part, a second end of the elastic element being connected to the roller bracket, and the elastic element drives the roller bracket and the roller into the extended state when the water tank is removed from the shell.

According to an embodiment of the present disclosure, the first end of the roller bracket is mounted on the mounting part through a pivot shaft, and the roller bracket retracts into or extends from the groove through rotation.

According to an embodiment of the present disclosure, the elastic element is a torsion spring, a support part of the torsion spring is arranged on the mounting part, and a torsion coil part of the torsion spring is fitted over the pivot shaft.

According to an embodiment of the present disclosure, the roller is a unidirectional wheel, and a rolling shaft is arranged on the roller bracket and cooperates with the unidirectional wheel.

According to an embodiment of the present disclosure, the roller is an omnidirectional wheel, and a rolling groove is arranged in the roller bracket and fitted with the omnidirectional wheel.

According to an embodiment of the present disclosure, the self-moving cleaning device includes a front omnidirectional wheel arranged at the bottom of the shell and offset from the water tank, and the roller of the roller assembly and the front omnidirectional wheel are in a same horizontal plane when the roller assembly is in the extended state.

According to an embodiment of the present disclosure, a support wheel is mounted at a bottom of the water tank, and the support wheel and the front omnidirectional wheel are in a same horizontal plane when the water tank is mounted on the mounting part.

According to one embodiment of the present disclosure, the self-moving cleaning device is a ground cleaning robot or a glass cleaning robot.

BRIEF DESCRIPTION OF THE DRAWINGS

Accompanying drawings are only used to illustrate the embodiment and shall not be considered as limitation on the present disclosure. Moreover, same reference numerals are used to denote same components throughout the drawings. In the accompanying drawings.

REFERENCE NUMERALS

Figure 1:
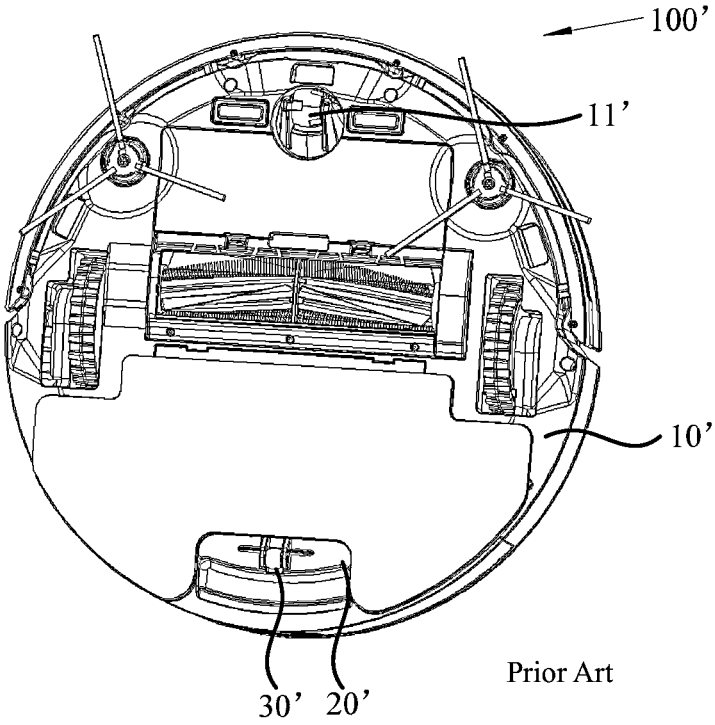
FIG. 1 is a structure diagram of a floor sweeping robot in related art.

100': floor sweeping robot; 10': shell; 11': omnidirectional wheel; 20': water tank; 30': roller; 100: ground cleaning robot; 10: shell; 11: mounting part; 111: groove; 12: front omnidirectional wheel; 13: rolling brush; 14: side brush; 20: water tank; 30: roller assembly; 31: roller; 311: rolling shaft; 32: roller bracket; 321: pivot hole; 33: torsion spring; 331: support part; 332: torsion coil part.

DETAILED DESCRIPTION OF THE DISCLOSURE

Exemplary embodiments of the present disclosure will be described in more detail below with reference to the accompanying drawings. Although the exemplary embodiments of the present disclosure are shown in the accompanying drawings, it should be understood that the present disclosure may be implemented in various forms rather than be limited by the embodiments set forth herein. It should be noted that a ground cleaning robot is described as an embodiment of a self-moving cleaning device, and cannot be construed as limitation on the protection scope of the self-moving cleaning device in the present disclosure. For example, the self-moving cleaning device of the present disclosure can also be a glass cleaning robot or other self-moving cleaning apparatuses, which belong to the protection scope of the self-moving cleaning device of the present disclosure.

It should be understood that terms used herein are only for the purpose of describing specific examples and are not intended to limit the present disclosure. Unless explicitly indicated otherwise, "a," "an" and "the" in singular forms may mean including plural forms. Terms "comprising," "containing" and "having" are inclusive and therefore indicate the existence of stated features, elements and/or components, but do not exclude the existence or addition of one or more other features, elements, components, and/or combinations thereof.

In the description of the present disclosure, unless explicitly specified and defined otherwise, terms "arranged" and "connected" should be understood broadly, and may be, for example, fixed connection, detachable connection, or integral connection; may also be direct connections or indirect connections via intervening structures.

For the convenience of description, spatial relative relation terms can be used to describe the relationship of one element or feature relative to another element or feature as shown in the drawings, such as "inner," "bottom," "end," "front," "rear," "length," "both sides," "up" and the like. Such terms are intended to include different orientations of mechanisms in use or operation other than those depicted in the drawings. For example, if the mechanisms in the drawings are inverted, the elements described as "under other elements or features" or "below other elements or features" will then be oriented as "on other elements or features" or "above other elements or features". Therefore, the term "below" for example can include orientations "above" and "below". The mechanisms can be otherwise oriented (rotated by 90 degrees or in other directions) and explained accordingly by the spatial relative relationship descriptors used herein.

Figure 2:
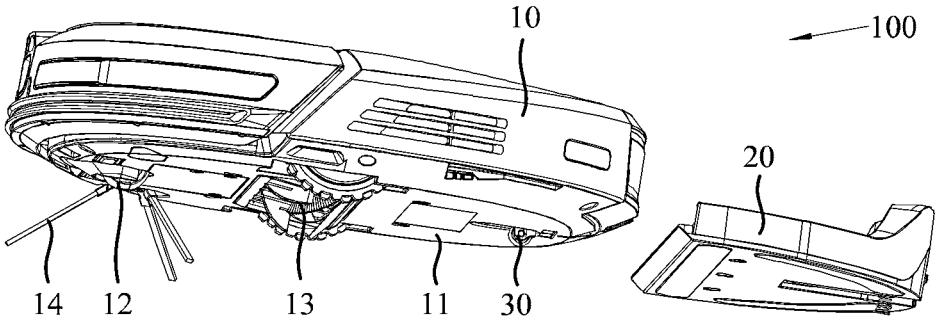
FIG. 2 is a split structure diagram of a self-moving cleaning device according to an embodiment of the present disclosure.
Figure 3:
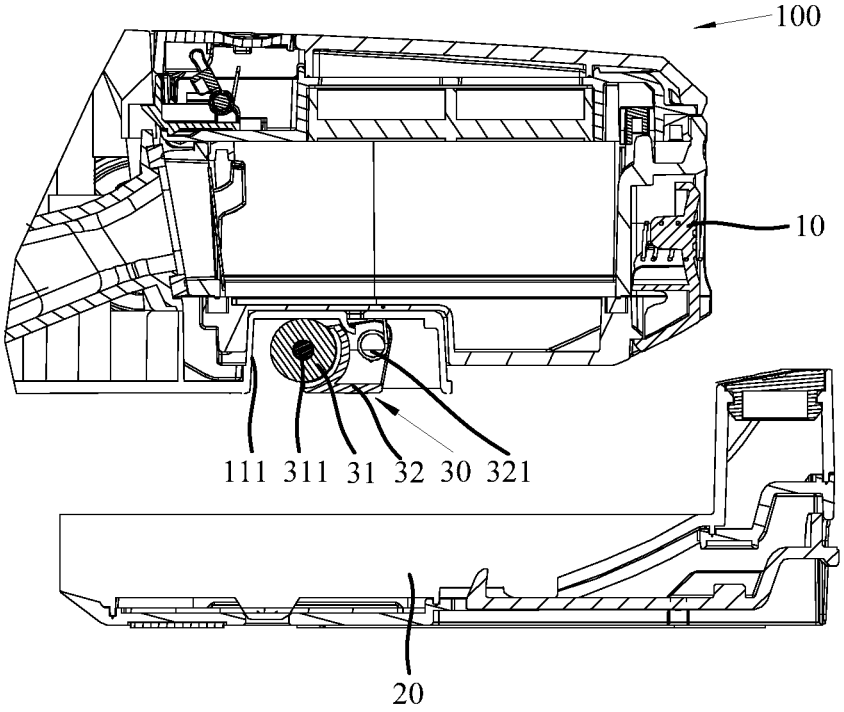
FIG. 3 is a sectional view of the self-moving cleaning device shown in FIG. 2.

As shown in FIGS. 2 and 3, according to embodiments of the present disclosure, in one embodiment of the present disclosure provides a self-moving cleaning device (such as a ground cleaning robot 100). The self-moving cleaning device includes a shell 10, a water tank 20 and a roller assembly 30. A mounting part 11 is arranged at the bottom of the shell 10, and the water tank 20 is detachably mounted on the mounting part 11. A groove 111 is arranged in the mounting part 11 (as shown in FIG. 3), and the roller assembly 30 is mounted on the mounting part 11 and can extend and retract. When the water tank 20 is mounted on the shell 10, the roller assembly 30 retracts into the groove 111 and is in a retracted state; and when the water tank 20 is removed from the shell 10, the roller assembly 30 extends from the groove 111 and is in an extended state.

Figure 4:
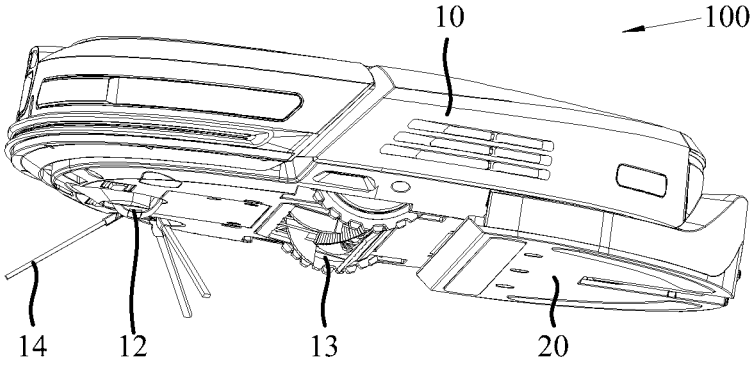
FIG. 4 is an assembly structure diagram of the self-moving cleaning device shown in FIG. 2.
Figure 5:
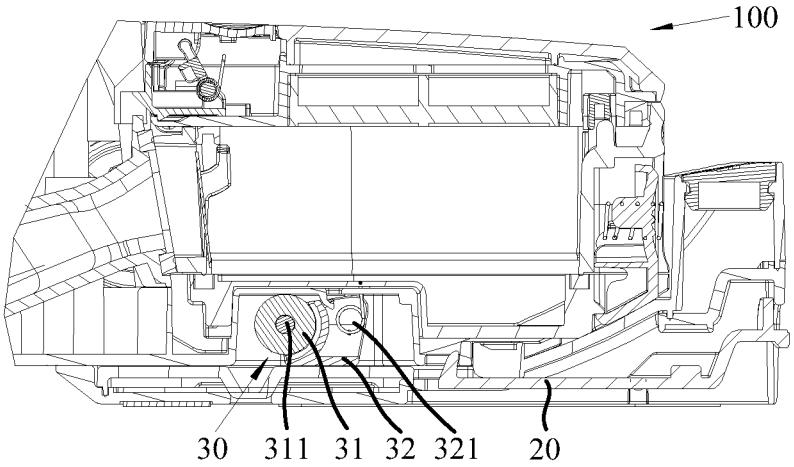
FIG. 5 is a sectional view of the self-moving cleaning device shown in FIG. 4.

In the present disclosure, by arranging the roller assembly 30 at the bottom of the self-moving cleaning device, when the water tank 20 is mounted to the mounting part 11 at the bottom of the shell 10, the roller assembly 30 retracts into the groove 111 under a force of the water tank 20 or by manual means, to avoid a phenomenon of interference between the roller assembly 30 and the water tank 20; when the water tank 20 is removed from the shell 10, the roller assembly 30 can automatically or manually extend from the groove 111 and get in contact with the ground, to realize an effect of supporting the self-moving cleaning device and avoid a phenomenon of unsteady operation of the self-moving cleaning device during movement when the water tank 20 is removed from the self-moving cleaning device. In one embodiment, as shown in FIGS. 4 and 5, when the water tank 20 is mounted to the mounting part 11 at the bottom of the shell 10, the self-moving cleaning device during operation supplies water to a cloth (not shown in the drawings) of the self-moving cleaning device through the water tank 20, and the self-moving cleaning device cleans the ground through the cloth; after the water tank 20 is removed from the shell 10, the self-moving cleaning device moves on the ground and cleans the ground through a rolling brush 13 and an side brush 14, and at this time, in order to avoid the phenomenon of the unsteady operation of the self-moving cleaning device caused by the removal of the water tank 20 from the self-moving cleaning device, the groove 111 is arranged in the mounting part 11 at the bottom of the shell 10 and the roller assembly 30 which can retract into the groove 111 is arranged on the mounting part 11. The roller assembly 30 cannot only retract into the groove 111 to avoid the phenomenon of interference with the water tank 20, but also extend from the groove 111 to support the self-moving cleaning device to prevent the phenomenon of the unsteady operation after the water tank 20 is removed from the self-moving cleaning device.

It should be noted that the above embodiments only describe in detail a structure in which the mounting part 11 is provided with the groove 111, and does not limit the specific position of the groove 111. For example, in some embodiments of the present disclosure, the groove may be arranged in the top of the water tank 20, or the groove 111 may be arranged in each of the mounting part 11 and the top of the water tank 20. When the water tank 20 is mounted to the mounting part 11 at the bottom of the shell 10, the roller assembly 30 can retract into the groove 111 under the force of the water tank or by manual means, to avoid the phenomenon of interference between the roller assembly 30 and the water tank 20; when the water tank 20 is removed from the shell 10, the roller assembly 30 can automatically or manually extend from the groove 111 and get in contact with the ground, to realize the effect of supporting the self-moving cleaning device. Further, the above embodiments do not limit the specific structure and movement mode of the roller assembly 30, that is, as long as the roller assembly 30 can realize stable retraction into the groove 111 and extension from the groove 111 to be in a stable state, it belongs to the protection scope of the roller assembly 30 of the embodiments. The specific structure and movement mode of the roller assembly 30 will be described in detail below.

Figure 6:
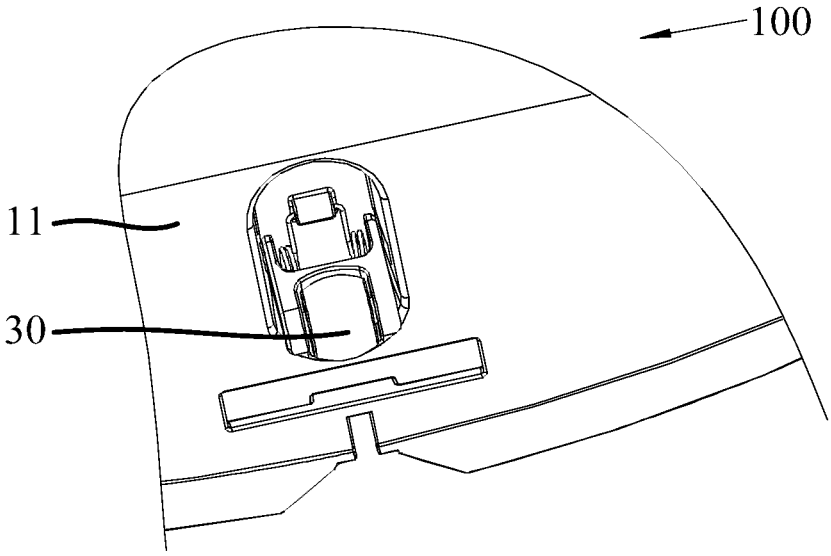
FIG. 6 is a partial structure diagram of the self-moving cleaning device shown in FIG. 2.
Figure 7:
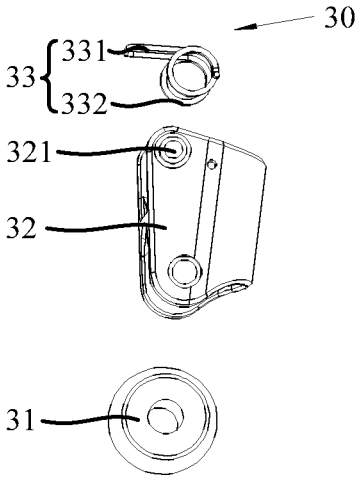
FIG. 7 is a structure diagram of a roller assembly according to an embodiment of the present disclosure.
Figure 8:
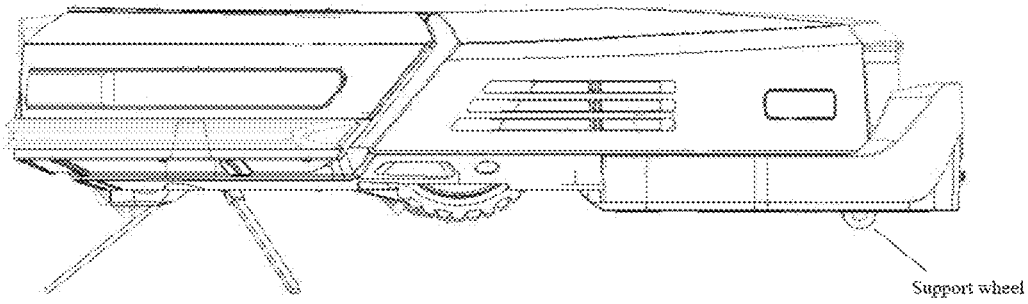
Figure 9:
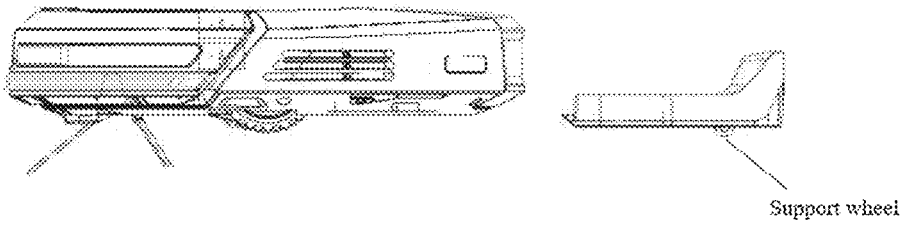

Further referring to FIGS. 2, 6, and 7, in some embodiments of the present disclosure, the roller assembly 30 includes a roller bracket 32 and a roller 31; a first end of the roller bracket 32 is mounted on the mounting part 11, and a second end of the roller bracket 32 is rotatably connected to the roller 31; and the roller bracket 32 can drive the roller 31 to retract into or extend from the groove 111.

In the embodiments, the roller bracket 32 provides support for the roller 31 to extend out of the groove 111 and get in contact with the ground, to avoid a phenomenon that the roller 31 cannot be in contact with the ground after extending out of the groove 111. In one embodiment, according to an embodiment of the present disclosure, the first end of the roller bracket 32 can be mounted on the mounting part 11 through a pivot shaft (the roller bracket 32 is provided with a pivot hole 321 in which the pivot shaft is fitted), and the roller 31 can retract into or extend from the groove 111 through the rotation of the roller bracket 32. Furthermore, the force that realizes the retraction of the roller 31 into the groove 111 through the rotation of the roller bracket 32 can be provided by the water tank 20, and the roller bracket 32 is pressed into the groove 111 under a thrust of the water tank 20. The force that realizes the retraction of the roller 31 into the groove 111 through the rotation of the roller bracket can also be realized manually. The force that realizes the extension of the roller 31 from the groove 111 through the rotation of the roller bracket can be provided by an elastic force of an elastic element, and the roller bracket 32 is pushed out of the groove 111 by the elastic element without restraint of the water tank 20. The force that realizes the extension of the roller 31 from the groove 111 through the rotation of the roller bracket can also be realized manually. Embodiments of the elastic element will be described in detail below.

It should be noted that the first end of the roller bracket 32 being mounted on the mounting part 11 through the pivot shaft is only a embodiment of the present disclosure rather than limitation on the way in which the roller bracket 32 is mounted on the mounting part 11. For example, the roller bracket 32 can also be connected to the mounting part 11 through bolts. When the water tank 20 is mounted on the mounting part 11 of the shell 10, the roller bracket 32 is horizontally mounted to the mounting portion 11 by bolts, so that the roller assembly 30 can retract into the groove 111; after the water tank 20 is removed from the shell 10, the roller bracket 32 is vertically mounted to the mounting part 11 through bolts, so that the roller assembly 30 can extend from the groove 111 and support the self-moving cleaning device. Such adjustment belongs to the protection scope of the mounting mode of the roller bracket 32 in the present disclosure.

Further referring to FIGS. 2, 6, and 7, according to an embodiment of the present disclosure, the roller assembly 30 also includes an elastic element, a first end of the elastic element being mounted to the mounting part 11, and a second end of the elastic element being connected to the roller bracket 32. When the water tank 20 is removed from the shell 10, the elastic element can drive the roller bracket 32 and the roller 31 to extend from the groove 111 and get into the extended state.

In this embodiment, the elastic element is connected to both the mounting part 11 and the roller bracket 32, so that the roller bracket 32 can be pushed out of the groove 111 by the elastic element without the restraint of the water tank 20, to improve the use experience of the roller assembly 30. In one embodiment, in an example where the first end of the roller bracket 32 is mounted on the mounting part 11 through the pivot shaft, the elastic element in this embodiment can be a torsion spring 33, a support part 331 of the torsion spring 33 being fixedly arranged on the mounting part 11, and a torsion coil part 332 of the torsion spring 33 being fitted over the pivot shaft. When the water tank 20 is mounted on the mounting part 11 at the bottom of the shell 10, the water tank 20 pushes the roller assembly 30 and the torsion spring 33, so that the torsion spring 33 is deformed and the roller assembly 30 is compressed into the groove 111 by the water tank 20. When the water tank 20 is removed from the shell 10, the roller assembly 30 and the torsion spring 33 lose the restraint of the water tank 20, and the torsion spring 33 returns to an original state and drives the roller assembly 30 to extend out of the groove 111 and get in contact with the ground. The roller assembly 30 can support the self-moving cleaning device, and at the same time, a torsion force of the torsion spring 33 itself can also have a supporting effect on the roller assembly 30 to avoid a phenomenon that the roller assembly 30 retracts into the groove 111 again under the gravity of the self-moving cleaning device.

It should be noted that the configuration of the elastic element as the torsion spring 33 is only a embodiment of the present disclosure rather than limitation on the protection scope of the elastic element. For example, the roller bracket 32 can also be directly mounted to the mounting part 11 through a leaf spring or a spring. When the water tank 20 is mounted to the mounting part 11 of the shell 10, the water tank 20 squeezes the leaf spring through the roller assembly 30 and makes it deformed, so that the roller assembly 30 can retract into the groove 111, When the water tank 20 is removed from the shell 10, the spring returns to the original state and drives the roller bracket 32 to extend from the groove 111 and get in contact with the ground, and supporting the self-moving cleaning device. Therefore, such adjustment belongs to the protection scope of the elastic element in the present disclosure.

Further referring to FIGS. 6 and 7, according to an embodiment of the present disclosure, the roller 31 is a unidirectional wheel, and the roller bracket 32 is provided with a rolling shaft 311 to cooperate with the unidirectional wheel.

In this embodiment, the roller 31 of the roller assembly 30 mainly has an effect of supporting the self-moving cleaning device. When the self-moving cleaning device moves, the roller 31 can move with a moving direction of the self-moving cleaning device, to improve the smoothness of movement of the self-moving cleaning device. In one embodiment, the roller 31 of this embodiment can be a solid roller or an inflatable roller. The specific structure and mounting method of the roller 31 will not be described here.

It should be noted that the configuration of the roller 31 as the unidirectional wheel in this embodiment is only an embodiment rather than limitation on the roller 31. For example, the roller 31 can also be an omnidirectional wheel, and the roller bracket 32 may be provided with a rolling groove to cooperate with the omnidirectional wheel. By the configuration of the roller 31 as the omnidirectional wheel, the mobility and steering flexibility of the self-moving cleaning device can be improved. Therefore, such adjustment belongs to the protection scope of the roller 31 of the present disclosure.

Further referring to FIGS. 2 and 7, according to an embodiment of the present disclosure, the self-moving cleaning device also includes a front omnidirectional wheel 12 arranged at the bottom of the shell 10 and offset from the water tank 20. After the roller assembly 30 extends from the groove 111, the roller 31 of the roller assembly 30 and the front omnidirectional wheel 12 are in a same horizontal plane.

In this embodiment, the front omnidirectional wheel 12 can provide a front support force for movement of the self-moving cleaning device, and the roller 31 of the roller assembly 30 can assist the front omnidirectional wheel 12 and provide rear support for the self-moving cleaning device. In this embodiment, by arranging the roller 31 of the roller assembly 30 and the front omnidirectional wheel 12 in the same horizontal plane, after the water tank 20 is removed from the shell 10, the roller assembly 30 can cooperate with the front omnidirectional wheel 12 to support the self-moving cleaning device, avoiding a phenomenon that the roller 31 or the front omnidirectional wheel 12 is off the ground during the movement of the self-moving cleaning device.

Further referring to FIGS. 2 and 7, according to an embodiment of the present disclosure, a support wheel (not shown in the drawings) is mounted at the bottom of the water tank 20. When the water tank 20 is mounted on the mounting part 11 of the shell 10, the support wheel and the front omnidirectional wheel 12 are in a same horizontal plane.

In this embodiment, by mounting the support wheel at the bottom of the water tank 20, when the water tank 20 is mounted to the bottom of the shell 10, the support wheel can cooperate with the front omnidirectional wheel 12 to support the self-moving cleaning device, avoiding a phenomenon that the water tank 20 is in contact with and rubs against the ground during the movement of the self-moving cleaning device. In the self-moving cleaning device of this embodiment, the roller assembly 30 is arranged at the bottom of the shell 10, and the support wheel is arranged at the bottom of the water tank 20, so that when the water tank 20 is mounted to the shell 10 of the self-moving cleaning device, the support wheel at the bottom of the water tank 20 supports the self-moving cleaning device; when the water tank 20 is removed from the shell 10 of the self-moving cleaning device, the roller assembly 30 at the bottom of the shell 10 supports the self-moving cleaning device. In this embodiment, the working stability of the self-moving cleaning device can be improved by the roller assembly 30 and the support wheel.

It should be noted that the embodiments only describes the structure of the ground cleaning robot 100 related to the inventive concept of the present disclosure, which does not mean that the ground cleaning robot 100 has no other structures.

It should be noted that the self-moving cleaning device according to the embodiments may also be a glass cleaning robot, and the internal structure and working mode of the glass cleaning robot are similar to those of the ground cleaning robot 100. Therefore, specific embodiments of the glass cleaning robot will not be described here.

What is claimed is:

1. A self-moving cleaning device, comprising:

a shell with a mounting part being arranged at a bottom of the shell;

a water tank detachably mounted to the mounting part;

a groove arranged in the mounting part;

a roller assembly, comprising a roller bracket and a roller, configured to be in an extended state and a retracted state, wherein, in the retracted state the roller completely retracts into the groove under the force of the water tank when the water tank is mounted on the shell, and in the extended state, the roller assembly extends from the groove when the water tank is removed from the shell.

2. The self-moving cleaning device according to claim 1, wherein a first end of the roller bracket is mounted on the mounting part, and a second end of the roller bracket is rotatably connected to the roller; and the roller bracket is configured to drive the roller to retract into or extend from the groove.

3. The self-moving cleaning device according to claim 2, wherein the roller assembly comprises an elastic element, a first end of the elastic element being mounted to the mounting part, a second end of the elastic element being connected to the roller bracket, and the elastic element drives the roller bracket and the roller into the extended state when the water tank is removed from the shell.

4. The self-moving cleaning device according to claim 3, wherein the first end of the roller bracket is mounted on the mounting part through a pivot shaft, and the roller bracket retracts into or extends from the groove through rotation.

5. The self-moving cleaning device according to claim 4, wherein the elastic element is a torsion spring, a support part of the torsion spring is arranged on the mounting part, and a torsion coil part of the torsion spring is fitted over the pivot shaft.

6. The self-moving cleaning device according to claim 2, wherein the roller is a unidirectional wheel, and a rolling shaft is arranged on the roller bracket and cooperates with the unidirectional wheel.

7. The self-moving cleaning device according to claim 2, wherein the roller is an omnidirectional wheel, and a rolling groove is arranged in the roller bracket and fitted with the omnidirectional wheel.

8. The self-moving cleaning device according to claim 2, wherein the self-moving cleaning device comprises a front omnidirectional wheel arranged at the bottom of the shell and offset from the water tank, and the roller of the roller assembly and the front omnidirectional wheel are in a same horizontal plane when the roller assembly is in the extended state.

9. The self-moving cleaning device according to claim 8, wherein a support wheel is mounted at a bottom of the water tank, and the support wheel and the front omnidirectional wheel are in a same horizontal plane when the water tank is mounted on the mounting part.

10. The self-moving cleaning device according to claim 1, wherein the self-moving cleaning device is a ground cleaning robot or a glass cleaning robot.

* * * * *